US006179671B1

(12) United States Patent
Ohsumi

(10) Patent No.: US 6,179,671 B1
(45) Date of Patent: Jan. 30, 2001

(54) ELECTRIC CONNECTOR WITH TERMINAL LOCKING MEMBER

(75) Inventor: Hideki Ohsumi, Shizuoka (JP)

(73) Assignee: Yazaki Corporation, Tokyo (JP)

( * ) Notice: Under 35 U.S.C. 154(b), the term of this patent shall be extended for 0 days.

(21) Appl. No.: 09/325,746

(22) Filed: Jun. 4, 1999

(30) Foreign Application Priority Data

Jun. 8, 1998 (JP) ..... 10-159683

(51) Int. Cl.[7] ..... H01R 13/436
(52) U.S. Cl. ..... 439/752; 439/595
(58) Field of Search ..... 439/595, 752

(56) References Cited

U.S. PATENT DOCUMENTS

| | | | | |
|---|---|---|---|---|
| 5,122,080 | | 6/1992 | Hatagishi et al. | 439/595 |
| 5,775,957 | * | 7/1998 | Fink et al. | 439/595 |
| 5,830,013 | * | 11/1998 | Saito et al. | 439/595 |

* cited by examiner

*Primary Examiner*—Gary F. Paumen
(74) *Attorney, Agent, or Firm*—Armstrong, Westerman, Hattori, McLeland & Naughton

(57) ABSTRACT

An electric connector with a terminal locking member is provided, which includes: a housing main body with a terminal accommodating chamber; a front holder having a terminal accommodating portion and to be fitted to the housing main body; a terminal locking member having a terminal through hole provided with an engaging portion and to be arranged between the housing main body and the front holder freely movably; and an electric terminal to be accommodated in the housing main body through the terminal accommodating chamber, the terminal through hole, and the terminal accommodating portion, wherein the electric terminal accommodated in the housing main body is locked by the engaging portion. The electric connector may further includes a resilient locking piece provided on the housing main body so that the electric terminal accommodated in the housing main body is locked by the resilient locking piece in addition to the lock by means of the engaging portion of the terminal locking member.

7 Claims, 6 Drawing Sheets

ELECTRIC CONNECTOR WITH TERMINAL LOCKING MEMBER

BACKGROUND OF THE INVENTION

1. Field of the Invention

The present invention generally relates to an electric connector to be applied mainly to a wiring harness to be mounted on a motor vehicle and more particularly, to an electric connector wherein an electric terminal accommodated in a connector housing main body is locked by a terminal locking member provided in the housing main body.

2. Description of the Related Art

As an electric connector provided with an terminal locking member, an electric connector K shown in FIG. 11 is disclosed in U.S. Pat. No. 5,122,080, for example.

The electric connector K has a with a spacing member b as a terminal locking member inserted from a side of a housing a. And, in a provisional engaging state of the spacing member b, an electric terminal c accommodated in the housing a is locked by a resilient locking piece d provided on the spacing member b, and in a final engaging state to be made by further shifting the spacing member b, the electric terminal c is locked by the coming-off preventing abutting portion e so as to secure the electric terminal c.

With respect to the above prior art electric connector K, since the resilient locking piece d and the coming-off preventing abutting portion e of the spacing member b are formed in a comb-like shape, the resilient locking piece d or the coming-off preventing abutting portion e is apt to be deformed when the spacing member b is inserted in the housing a even in case of the electric terminal c being in a state of incomplete insertion, wherein the incomplete insertion of the electric terminal c into the housing a could not necessarily be detected surely.

Also, since the lock of the electric terminal c changes from a means of the resilient locking piece d to a means of the coming-off preventing abutting portion e as the spacing member b, is inserted the terminal holding force is weakened, thereby causing coming-off of the electric terminal c.

Further, since a deformation preventing mechanism of the resilient locking piece d is not provided, the locking force by the resilient locking piece d would become weakened.

SUMMARY OF THE INVENTION

In view of the foregoing, an object of the present invention is to provide an electric connector provided with a terminal locking member, wherein incomplete insertion of the electric terminal can be clearly detected, the electric terminal can be surely locked, and workability in connector assembly is better.

In order to achieve the above-described object, as a first aspect of the present invention, an electric connector with a terminal locking member includes a housing main body with a terminal accommodating chamber; a front holder having a terminal accommodating portion and to be fitted to the housing main body; a terminal locking member having a terminal through hole provided with an engaging portion and to be arranged between the housing main body and the front holder freely movably; and an electric terminal to be accommodated in the housing main body through the terminal accommodating chamber, the terminal through hole, and the terminal accommodating portion, wherein the electric terminal accommodated in the housing main body is locked by the engaging portion.

As a second aspect of the present invention, in the structure with the above first aspect, the electric connector further includes a resilient locking piece provided on the housing main body so that the electric terminal accommodated in the housing main body is locked by the resilient locking piece in addition to the lock by means of the engaging portion of the terminal locking member.

As a third aspect of the present invention, in the structure with the above first or second aspect, the electric connector further includes: a rear holder having a terminal insertion hole and to be fitted to the housing main body; a terminal locking member driving portion having a cam groove and to be mounted on the rear holder freely movably back and forth; and a cam projection provided on the terminal locking member, wherein the terminal locking member is shifted by advancing the terminal locking member driving portion after engaging the cam projection with the cam groove and after inserting the electric terminal into the terminal accommodating portion through the terminal insertion hole.

As a fourth aspect of the present invention, in the structure with any one of the above aspects, the engaging portion of the terminal locking member comprises oppositely facing engaging projections formed by notching an edge of the terminal through hole and the electric terminal has a thin portion with a step portion so that the electric terminal is locked by abutting the engaging projections against the step portion.

Further, as a fifth aspect of the present invention, an electric connector with a terminal locking member includes: a housing main body with a terminal accommodating chamber and with a resilient locking piece; a front holder having a terminal accommodating portion and to be fitted to the housing main body; a terminal locking member having a terminal through-hole provided with an engaging rib and to be arranged between the housing main body and the front holder freely movably; and an electric terminal having an engaging recess and to be accommodated in the housing main body through the terminal accommodating chamber, the terminal through-hole, and the terminal accommodating portion, wherein the electric terminal accommodated in the housing main body is locked by engaging the resilient locking piece with the engaging recess and further displacement of the resilient locking piece is prevented by means of abutment of the engaging rib against the resilient locking piece.

As a sixth aspect of the present invention, in the structure with the above fifth aspect, the electric connector further includes: a rear holder having a terminal insertion hole and to be fitted to the housing main body; a terminal locking member driving portion having a cam groove and to be mounted on the rear holder freely movably back and forth; and a cam projection provided on the terminal locking member, wherein the terminal locking member is shifted by advancing the terminal locking member driving portion after engaging the cam projection with the cam groove and after inserting the electric terminal into the terminal accommodating portion through the terminal insertion hole.

According to the present invention as described hereinabove, since the electric connector in accordance with the present invention uses the frame-like terminal locking member which is not apt to be deformed compared to the prior art terminal locking member having a comb-like shape, sure locking of the electric terminal can be attained, and also, since the frame-like terminal locking member hardly deforms when impacting the electric terminal when in a state of incomplete insertion, the incomplete insertion can be detected clearly, thereby improving reliability of the detection.

And, since the electric terminal is locked by the terminal locking member besides the resilient locking piece, a terminal holding force is increased, thereby surely preventing coming-off of the electric terminal e.g. during terminal insertion work.

Further, since the vertical movement of the terminal locking member can be done by means of the terminal locking member driving portion which is moved in the coupling operation direction of the connector, a space required for operating the terminal locking member can be small, thereby improving e.g. workability of connector assembly.

The above and other objects and features of the present invention will become more apparent from the following description taken in conjunction with the accompanying drawings.

DESCRIPTION OF THE PREFERRED EMBODIMENT

An embodiment of the present invention will now be described in further detail with reference to the accompanying drawings.

Figure 1:
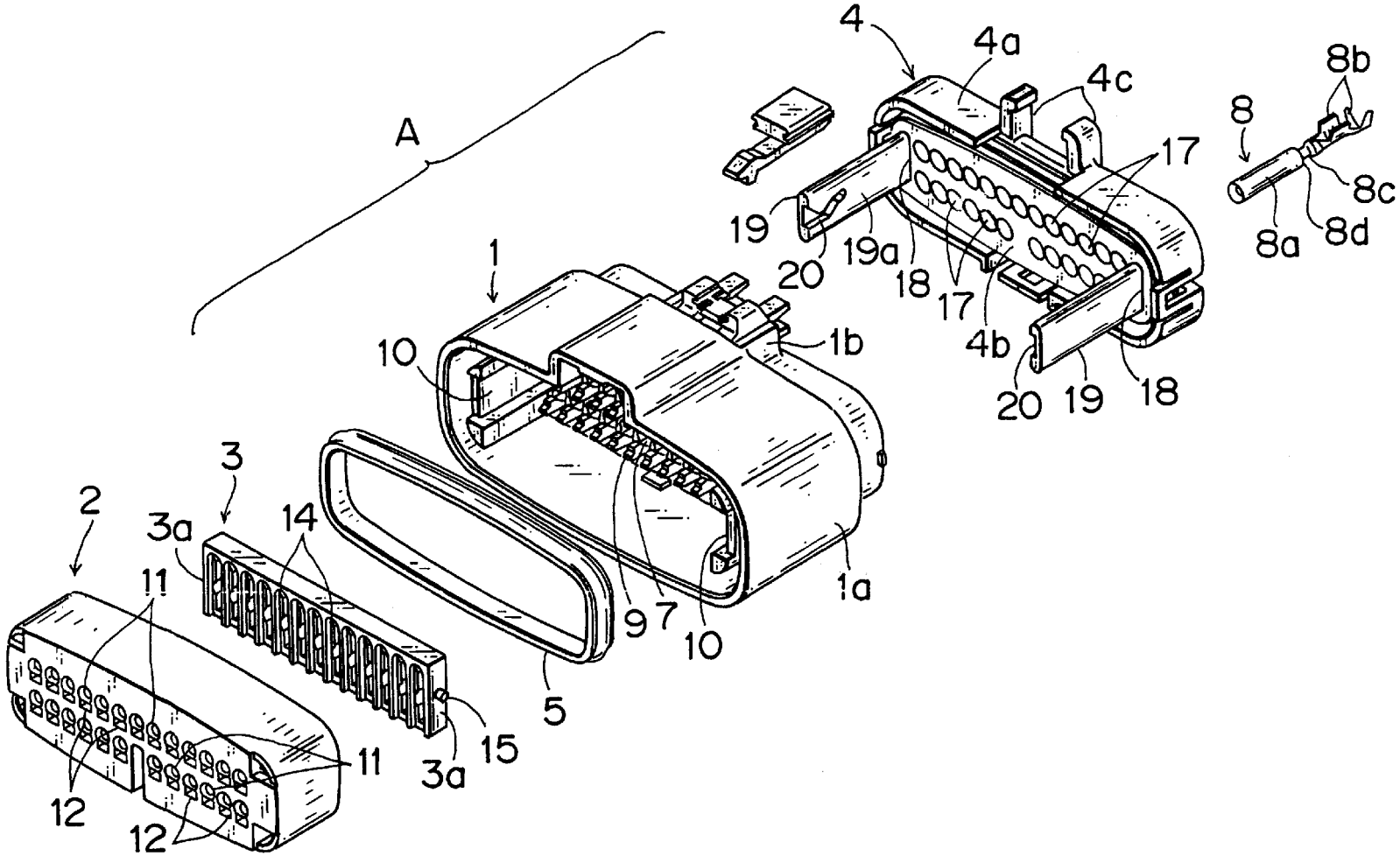
FIG. 1 is an exploded perspective view showing an embodiment of an electric connector having a terminal locking member in accordance with the present invention.

FIG. 1 is an exploded perspective view showing an embodiment of an electric connector A having a terminal locking member in accordance with the present invention.

The electric connector A consists of a housing main body 1, a front holder 2, a terminal locking member 3, a rear holder 4, and packing-members 5,5'.

The housing main body 1 has a plurality of terminal accommodating chambers 7 arranged inside a tubular skirt 1*a* in two layers so as to accommodate female electric terminals 8 therein. On the lower side of each of the terminal accommodating chambers 7, a resilient locking piece 9 projects forward.

Between the inside of the skirt 1*a* and each of the terminal accommodating chambers 7 located on the both sides, a guide groove 10 is provided for supporting a terminal locking member driving portion 19 of a rear holder 4 (described later).

Figure 2:
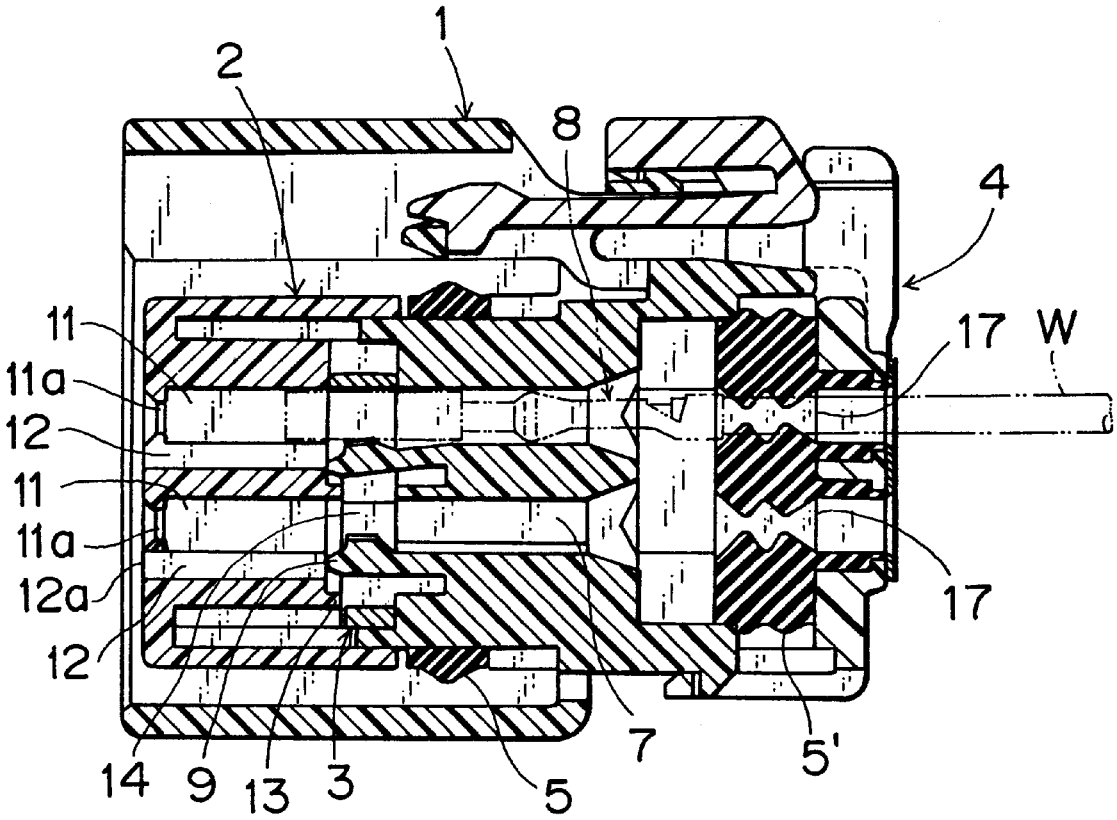
FIG. 2 is an longitudinal sectional view showing an assembled state of the electric connector of FIG. 1.

The front holder 2 has a plurality of terminal accommodating portions 11 therein which correspond to the terminal accommodating chambers 7 of the housing main body 1, and is fitted in the housing main body 1 in front of the terminal accommodating chambers 7 so that electrically contacting portions 8*a* of the respective electric terminals 8 are accommodated in the terminal accommodating portions 11. In front of the terminal accommodating portion 11, as shown in FIG. 2, a receiving hole 11*a* is formed for receiving the mating electric terminal.

Under the terminal accommodating portion 11 a releasing hole 12 is provided in parallel with the terminal accommodating portion 11, which releasing hole 12 has a opening 12*a* on one end under the receiving hole 11*a* of the terminal accommodating portion 11 and also has a deformation preventing projection 13 corresponding to the resilient locking piece 9 on the other end.

The terminal locking member 3 is formed in a frame-like shape with two layers of terminal through-holes 14, each having a circular shape aligned with the terminal accommodating chamber 7 of the housing main body 1 and also to the terminal accommodating portion 11 of the front holder 2 and is provided with a pin-like cam projection 15 projecting outwardly from each of the sidewalls 3*a*.

Figure 3:
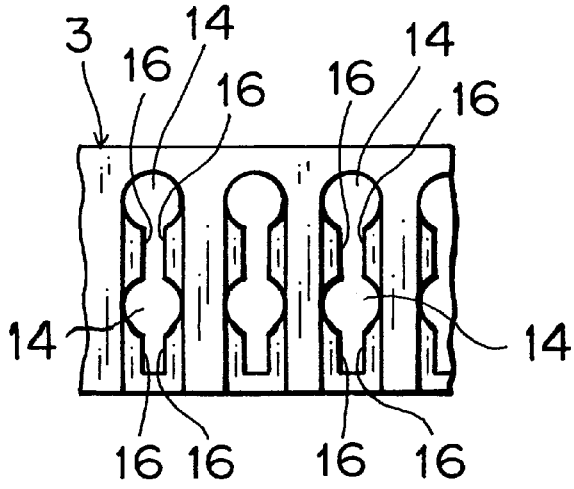
FIG. 3 is a front view of the terminal locking member of FIG. 1, showing a structure of a terminal through-hole thereof.

As is shown in FIG. 3, under the terminal through-hole 14 a pair of engaging projections 16 facing each other and acting as an engaging portion are provided, which engaging projections 16 are formed by narrowly notching the terminal through hole 14.

The rear holder 4 consists of a tubular periphery portion 4*a* to be fitted to the rear end of the housing main body 1 and a terminal holding portion 4*b* provided inside the periphery portion 4*a*. The rear holder 4 is locked to the housing main body 1 by engaging a gate-like lock portion 4*c* formed on the rear holder 4 with an engaging portion lb of the housing main body 1.

The terminal holding portion 4*b* is provided with a plurality of terminal insertion holes 17 each corresponding to the respective terminal accommodating chambers 7 of the housing main body 1 and also is provided with a driving portion attaching hole 18 on both sides thereof. Terminal locking member driving portions 19 in a strip-like shape are inserted through the respective driving portion attaching holes 18 and are movable forwardly and rearwardly by moving the back of the terminal holding portion 4*b*. Each of the terminal locking member driving portions 19 is provided with a cam groove 20 on an inner surface 19*a* thereof at a front portion thereof.

On the electric terminal 8 a thin portion 8*c* is formed between an electrically contacting portion 8*a* having a cylindrical shape and a wire connecting portion 8*b*, and an electric wire W (shown in FIG. 2) is connected to the wire connecting portion 8*b*. A diameter of the thin portion 8*c* is smaller than an interval between the oppositely facing engaging projections 16 of the terminal locking member 3.

Though the above electric terminal 8 has an electrically contacting portion of a pole-type, an electric terminal having an electrically contacting portion of a box-type is applicable in a similar manner.

Next, a process is described for locking the electric terminal 8 by means of operating the terminal locking member 3.

First of all, the front holder 2, the terminal locking member 3, and the rear holder 4 are assembled on the housing main body 1 with use of packing-members 5,5' as shown in FIG. 2. The electric terminal 8 connected to the electric wire W is inserted from the side of the electrically contacting portion 8*a* into the terminal insertion hole 17 of the rear holder 4, the terminal accommodating chamber 7 of the housing main body 1, and the terminal through-hole 14 of the terminal locking member 3 in turn, and finally the electrically contacting portion 8*a* is fitted in the terminal accommodating portion 11 of the front holder 2.

Figure 4:
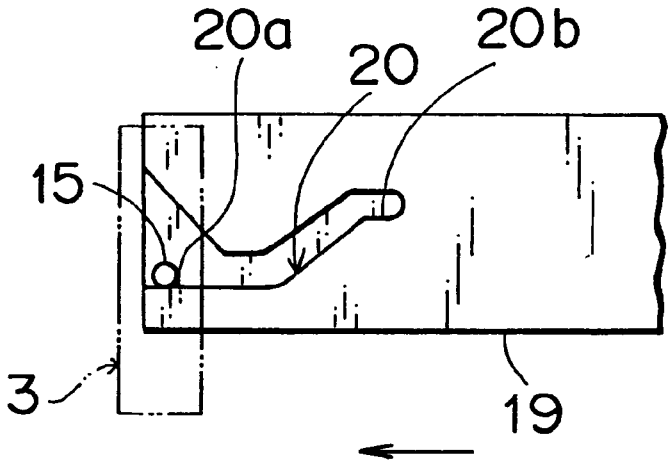
FIG. 4 is a side view showing locational relation between a cam groove of a terminal locking member driving portion and a cam projection of the terminal locking member of FIG. 1.
Figure 6:
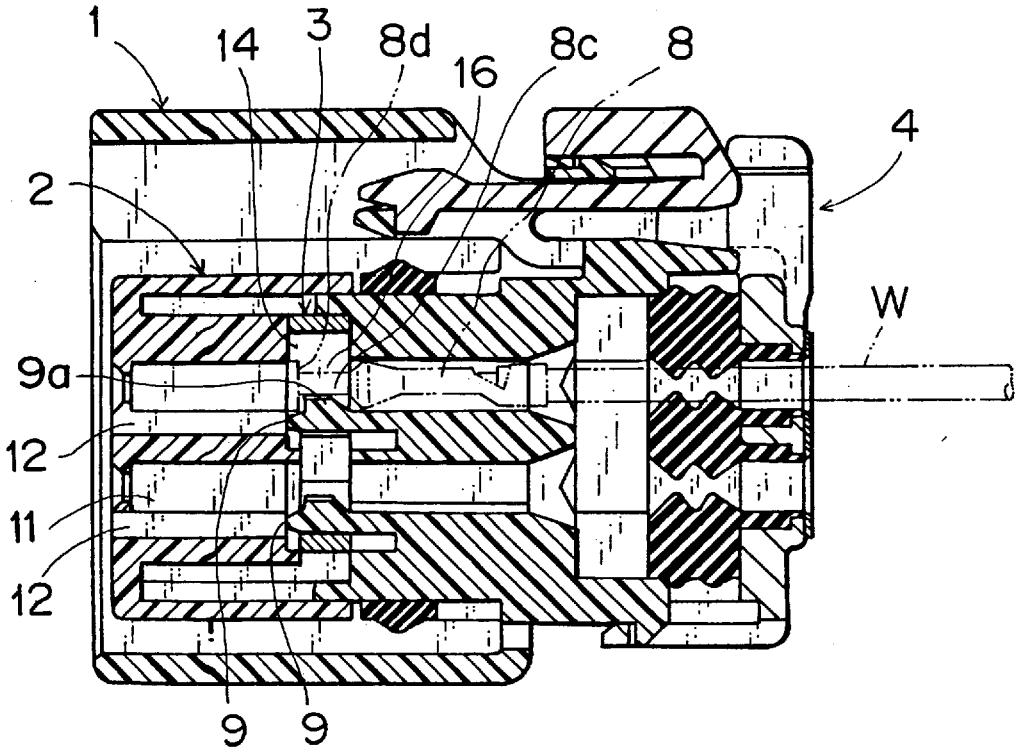
FIG. 6 is an longitudinal sectional view showing the similar state of FIG. 2, wherein an electric terminal is locked by upwardly shifting the terminal locking member.

The electric terminal 8 is locked on the housing main body 1 by means of engagement between a step portion 8*d*, which is formed at the boundary of the thin portion 8*c* and the electrically contacting portion 8*a*, and an engaging projection 9*a* of the resilient locking piece 9, as shown in FIG. 6. In this state, the cam projection 15 of the terminal locking member 3 is positioned at a lower portion 20*a* of the cam groove 20 of the terminal locking member driving portion 19 as shown in FIG. 4.

Figure 5:
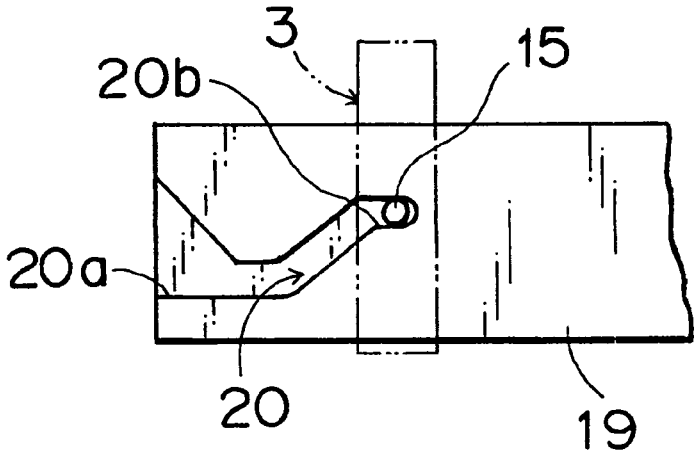
FIG. 5 is a side view showing location of the cam projection after shifting the terminal locking member by forwarding the terminal locking member driving portion of FIG. 4.

By advancing the terminal locking member driving portion 19 in the arrow direction, the cam projection 15 of the terminal locking member 3 upwardly shifts to a upper portion 20*b* of the cam groove 20 of the terminal locking member driving portion 19 along the cam groove 20, as shown in FIG. 5, that is, the terminal locking member 3 upwardly shifts, as shown in FIG. 5 or FIG. 6, whereby the electric terminal 8 is locked by the engaging projection 16 of the terminal locking member 3 by means of abutment of the engaging projection 16 against the step portion 8*d* of the electric terminal 8.

Figure 7:
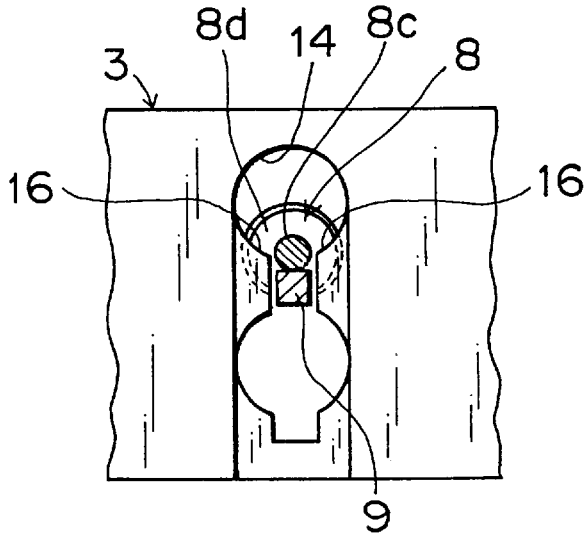
FIG. 7 is a front view showing a locking state of the electric terminal shown in FIG. 6 by means of a resilient locking piece and an engaging portion.

Accordingly, as is shown in FIG. 7, the electric terminal 8 is double locked by both of the resilient locking piece 9 of the housing main body 1 at the step portion 8*d* and the engaging projection 16 of the terminal locking member 3.

In case of the electric terminal 8 being in a state of incomplete insertion, the engaging projection 16 of the terminal locking member 3 abuts against the electrically contacting portion 8*a* of the electric terminal 8 and accordingly the upward shift of the terminal locking member 3 is hindered.

In order to release the electric terminal 8 from the housing main body 1, the terminal locking member 3 is shifted downward by means of moving the terminal locking member driving portion 19 back and simultaneously the thin portion 8*c* of the electric terminal 8 is disengaged from the resilient locking piece 9 by inserting a thin jig (not shown) from the opening 12*a* into the releasing hole 12 of the front holder 2, and then the electric wire W connected to the electric terminal 8 is drawn.

Though the above-described embodiment has the electric terminal 8 with the thin portion 8*c*, a case of an electric terminal having no thin portion is described hereinafter.

Figure 8:
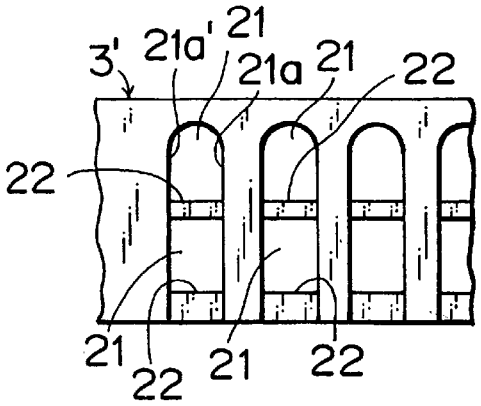
FIG. 8 is a plan view showing a structure of another embodiment of a terminal locking member in accordance with the present invention.

FIG. 8 is a plan view showing a structure of another embodiment of a terminal locking member in accordance with the present invention. A terminal locking member 3' is provided with a terminal through hole 21 which has an engaging rib 22 formed between sidewalls 21*a*, 21*a*' of the hole 21 instead of the terminal through hole 14 having the engaging projections 16 in the previous terminal locking member 3. Since the other structure is the same as of the previous terminal locking member 3, its explanation will be omitted hereinafter.

Process of mounting the terminal locking member 3', replacing the previous terminal locking member 3, and of locking an electric terminal 23 having no thin portion will be explained.

Figure 9:
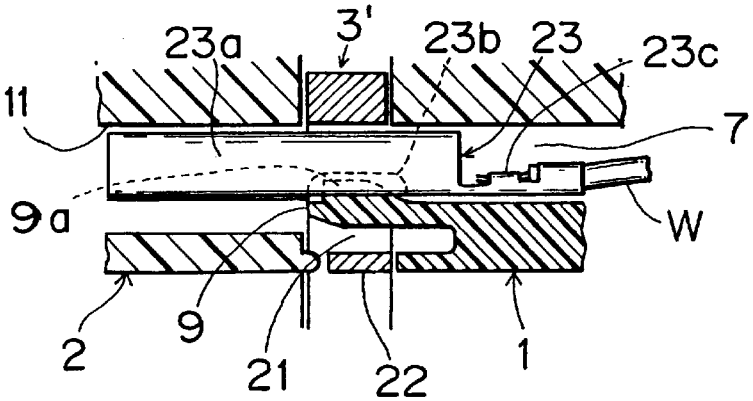
FIG. 9 is an longitudinal sectional view showing a process of locking an electric terminal not having a thin portion by means of the terminal locking member of FIG. 8.

FIG. 9 shows a state that the electric terminal 23 is inserted in the terminal accommodating chamber 7 of the housing main body 1 and in the terminal accommodating portion 11 of the front holder 2.

The electric terminal 23 is a female electric terminal having a box-like electrically contacting portion 23*a* with an engaging recess 23*b* on the bottom thereof and also having, in the rear thereof, a wire connecting portion 23*c* to which the electric wire W is connected. The electric terminal 23 is not provided with the corresponding portion to the thin portion 8*c* of the above electric terminal 8.

The electric terminal 23 is locked by engaging the engaging projection 9*a* of the resilient locking piece 9 with the engaging recess 23*b* of the electrically contacting portion 23*a*. In this state, the terminal locking member 3' is positioned similarly to the position of the terminal locking member 3 shown in FIG. 4.

Figure 10:
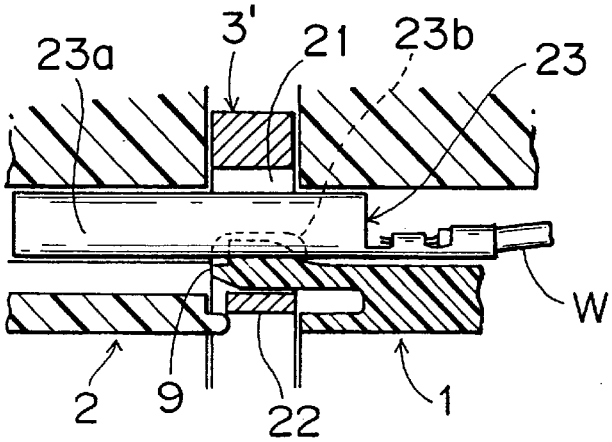
FIG. 10 is an longitudinal sectional view showing a state of restricting a resilient locking piece by means of the terminal locking member shown in FIG. 9.
Figure 11:
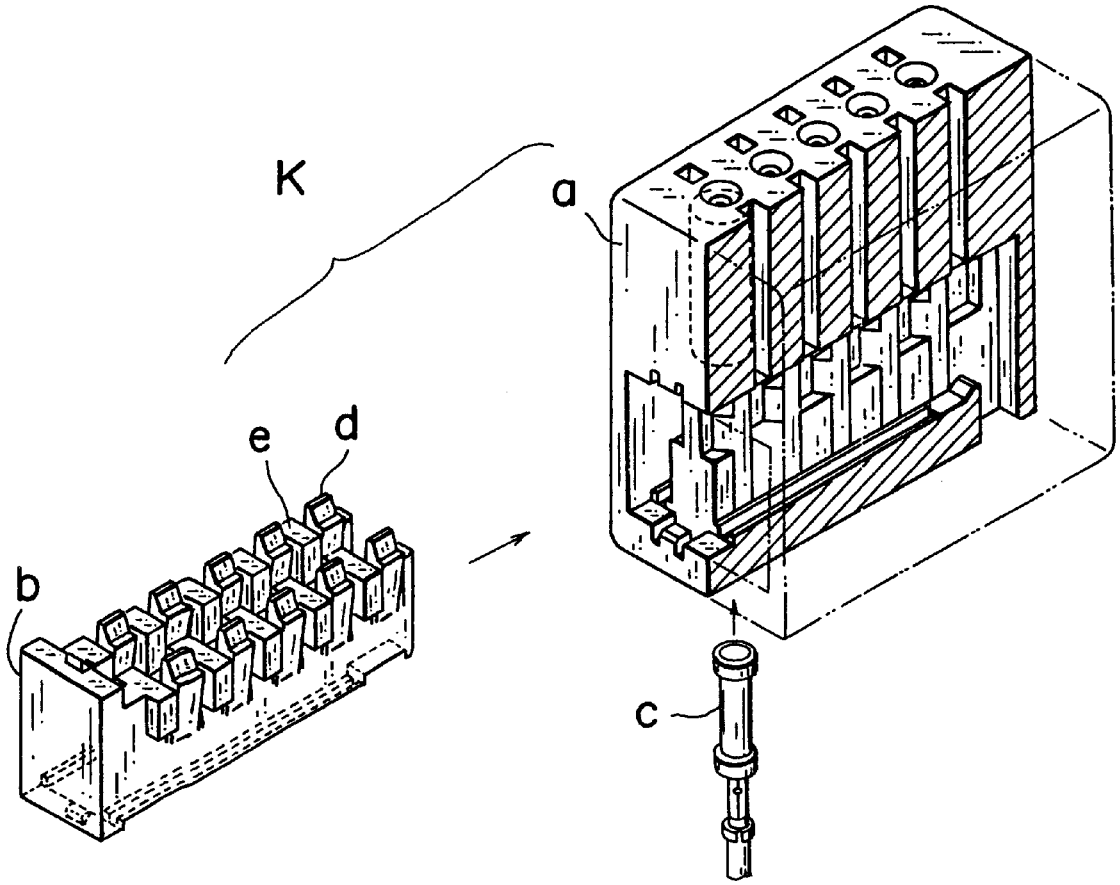
FIG. 11 PRIOR ART
FIG. 11 is an exploded perspective view showing a prior art electric connector with a spacing member.

With upward shift of the terminal locking member 3' caused by advancement of the terminal locking member driving portion 19, the engaging rib 22 provided on the terminal through hole 21 rises up to the underneath of the resilient locking piece 9 thereby to prevent downward deformation of the resilient locking piece 9, as shown in FIG. 10. With this, coming-off of the resilient locking piece 9 from the engaging recess 23*b* of the electric terminal 23 is prevented and then the electric terminal 23 is still secured.

In case the electric terminal 23 is in a state of incomplete insertion, the resilient locking piece 9 interferes with the engaging rib 22 of the terminal locking member 3' so that the terminal locking member 3' is hindered from moving upward, thereby surely detecting the incomplete insertion.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An electric connector with a terminal locking member, comprising:

a housing main body with a terminal accommodating chamber;

a front holder having a terminal accommodating portion and to be fitted to said housing main body;

a terminal locking member having a terminal through-hole provided with a terminal engaging portion communicating with said terminal through-hole, said terminal locking member being disposed between said housing main body and said front holder and arranged to be freely movable with respect to said housing main body and said front holder; and an electric terminal to be accommodated in said housing main body through said terminal accommodating chamber, said terminal through-hole, and said terminal accommodating portion, whereby said electric terminal accommodated in said housing main body is lockingly engaged by said engaging portion.

2. The electric connector according to claim 1, further comprising a resilient locking piece provided on said housing main body so that said electric terminal accommodated in said housing main body is locked by said resilient locking piece in addition to the lock by means of said engaging portion of said terminal locking member.

3. The electric connector according to claim 1, further comprising:

a rear holder having a terminal insertion hole and to be fitted to said housing main body;

a terminal locking member driving portion having a cam groove and to be mounted on said rear holder freely movably back and forth; and a cam projection provided on said terminal locking member, wherein said terminal locking member is shifted by advancing said terminal locking member driving portion after engaging said cam projection with said cam groove and after inserting said electric terminal into said terminal accommodating portion through said terminal insertion hole.

4. The electric connector according to claim 2, further comprising:

a rear holder having a terminal insertion hole and to be fitted to said housing main body;

a terminal locking member driving portion having a cam groove and to be mounted on said rear holder freely movably back and forth; and a cam projection provided on said terminal locking member, wherein said terminal locking member is shifted by advancing said terminal locking member driving portion after engaging said cam projection with said cam groove and after inserting said electric terminal into said terminal accommodating portion through said terminal insertion hole.

5. The electric connector according to any one of claims 1–4, wherein said engaging portion of said terminal locking member comprises oppositely facing engaging projections formed by notching an edge of said terminal through-hole, and said electric terminal has a thin portion with a step portion so that said electric terminal is locked by abutting said engaging projections against said step portion.

6. An electric connector with a terminal locking member, comprising:

a housing main body with a terminal accommodating chamber and with a resilient locking piece;

a front holder having a terminal accommodating portion and to be fitted to said housing main body;

a terminal locking member having a terminal through-hole provided with an engaging rib and being arranged to be freely movable between said housing main body and said front holder; and an electric terminal having an engaging recess and to be accommodated in said housing main body through said terminal accommodating chamber, said terminal through-hole, and said terminal accommodating portion, wherein said electric terminal accommodated in said housing main body is locked by engaging said resilient locking piece with said engaging recess and further displacement of said resilient locking piece is prevented by means of abutment of said engaging rib against said resilient locking piece.

7. The electric connector according to claim 6, further comprising:

a rear holder having a terminal insertion hole and to be fitted to said housing main body;

a terminal locking member driving portion having a cam groove and to be mounted on said rear holder freely movably back and forth; and a cam projection provided on said terminal locking member, wherein said terminal locking member is shifted by advancing said terminal locking member driving portion after engaging said cam projection with said cam groove and after inserting said electric terminal into said terminal accommodating portion through said terminal insertion hole.

* * * * *